US007134149B2

(12) United States Patent
Sato

(10) Patent No.: US 7,134,149 B2
(45) Date of Patent: Nov. 14, 2006

(54) FACE MASK FOR DIVING

(75) Inventor: Hiromasa Sato, Tokyo (JP)

(73) Assignee: Tabata Co., Ltd., Tokyo (JP)

( * ) Notice: Subject to any disclaimer, the term of this patent is extended or adjusted under 35 U.S.C. 154(b) by 198 days.

(21) Appl. No.: 10/685,527

(22) Filed: Oct. 16, 2003

(65) Prior Publication Data

US 2004/0078874 A1 Apr. 29, 2004

(30) Foreign Application Priority Data

Oct. 18, 2002 (JP) ..... 2002-340137

(51) Int. Cl.
*A61F 9/02* (2006.01)

(52) U.S. Cl. ..... 2/431; 351/43

(58) Field of Classification Search ..... 2/431, 2/445, 448; 24/170; 351/43
See application file for complete search history.

(56) References Cited

U.S. PATENT DOCUMENTS 5,611,644 A * 3/1997 Lutz ..... 405/186
6,350,030 B1 * 2/2002 Fujima ..... 351/43
6,477,717 B1 * 11/2002 Winefordner et al. ..... 2/428
6,708,349 B1 * 3/2004 Semeia ..... 2/426

FOREIGN PATENT DOCUMENTS

JP 1997-132193 5/1997
JP 2001-218869 8/2001

* cited by examiner

*Primary Examiner*—Katherine Moran
(74) *Attorney, Agent, or Firm*—Clark & Brody

(57) ABSTRACT

Here is disclosed a face mask provided with a rotation angle regulating means for stepwise variation of an angle of each buckle relative to associated lens frame side wall. A buckle is rotatably attached to the lens frame side wall of the face mask and the lens frame side wall and the buckle are formed with the rotation angle regulating means comprising one or more protrusions and depressions adapted to be releasably brought into mutual engagement.

5 Claims, 6 Drawing Sheets

FACE MASK FOR DIVING

BACKGROUND OF THE INVENTION

This invention relates to a face mask suitable to be used for diving or the like.

In a face mask used for diving or the like, it is well known to connect a strap to a lens frame of the face mask by means of buckles in a length-adjustable manner as disclosed in Japanese Patent Application Publication No. 2001-218869A. It is also well known to make the buckles rotatable relative to the lens frame and thereby to improve fitness of the face mask during use thereof as disclosed in Japanese Patent Application Publication No. 1997-132193A.

In the case of the buckle rotatable face mask as disclosed in the above-cited Publication, it is easy for the wearer to adjust the strap at a desired position relative to the lens frame but the strap may shift from this desired position as the buckles unintentionally are rotated during use of the face mask. Consequently, it may be sometimes difficult to retain the strap at the adjusted position.

SUMMARY OF THE INVENTION

It is an object of this invention to provide a face mask improved so that a position of the strap put around a wearer's head can be easily adjusted relative to the lens frame and the strap can be reliably retained at this position once it has been adjusted.

According to this invention, there is provided a face mask comprising a front lens, a skirt extending rearward from the front lens, a lens frame adapted to fix a front end of the skirt to a peripheral edge of the lens, a strap put around a mask wearer's head and buckles rotatably coupled to opposite side walls of the lens frame used to adjust a length of the strap along its longitudinally opposite extremities, respectively.

This invention further comprises an angle control means being formed on each of the side walls of the lens frame and each of the buckles associated with the side wall and adapted to be releasably brought into mutual engagement so as to retain the buckle at a predetermined rotation angle with respect to the side wall.

This invention includes the following embodiments.

The angle control means comprises a first engagement member formed on each of the side walls of the lens frame and a second engagement member formed on the buckle associated with the side wall and one of the first and second engagement members is provided in the form of a plurality of depressions and the other is provided in the form of a protrusion adapted to be releasably engaged with one of the depressions.

Each of the buckles comprises a first supporting member having a shaft adapted to be detachably and rotatably engaged with a bearing formed on the side wall of the lens frame, a second supporting member opposed to the first supporting member with the strap lying therebetween and having one end in a longitudinal direction of the strap pivotably supported by the first supporting member and a spring means interposed between the first and second supporting members and biasing the other end of the second supporting member to be pressed against the strap and wherein the second engagement member is formed integrally with the spring means.

The spring means comprises a first spring component extending in a transverse direction of the strap and pressed against the first and second supporting members, and a second spring component extending from the first spring component in the longitudinal direction of the strap and adapted to be elastically and releasably engaged with the first engagement member formed on the side wall of the lens frame.

At least one of the first and second engagement member is provided in form of a plurality of the engagement members arranged on one and same circular circumference defined around the shaft.

The lens frame or each of the buckles is provided with a stopper means serving to prevent the buckle from rotating to a position at which the buckle falls off from the lens frame during use of the face mask.

The face mask according to this invention has advantageous effects that the rotation angle control means provided between the lens frame and the buckles to ensure that the rotation angle of the buckles rotatably attached to the lens frame can be stepwise varied. This unique arrangement is effective not only to facilitate the strap to be adjusted to a desired position but also to eliminate an anxiety that the strap might be unintentionally shift from this desired position.

DETAILED DESCRIPTION OF THE PREFERRED EMBODIMENTS

Details of the face mask according to this invention will be more fully understood from the description given hereunder with reference to the accompanying drawings.

Figure 1:
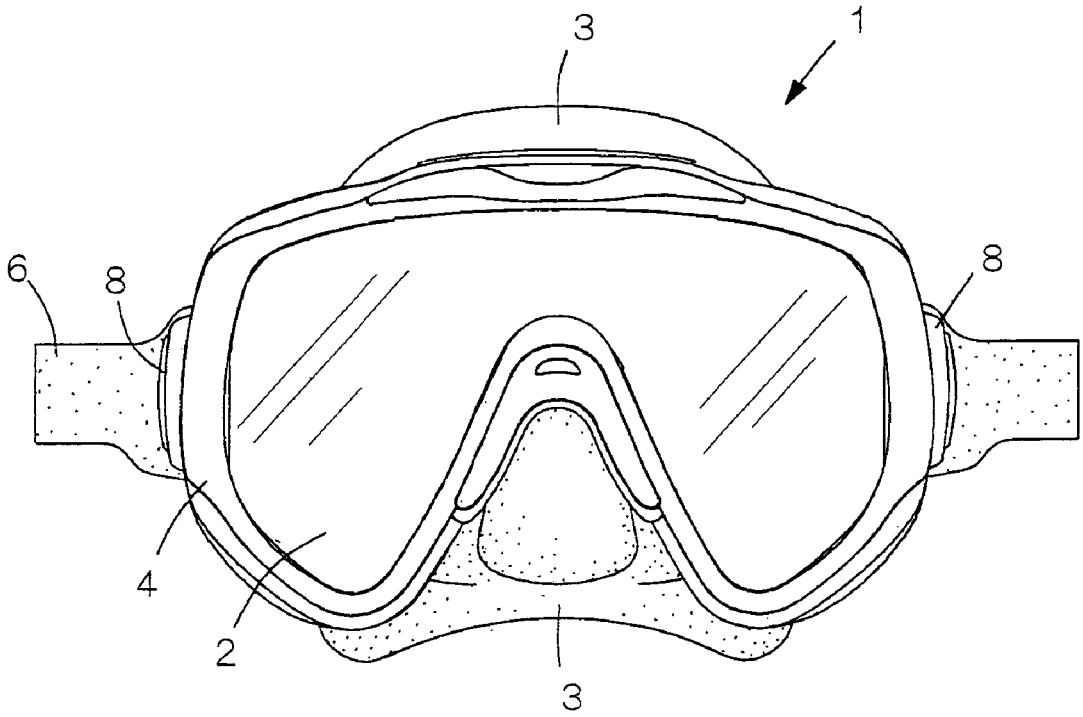
FIG. 1 is a front view of a face mask.
Figure 2:
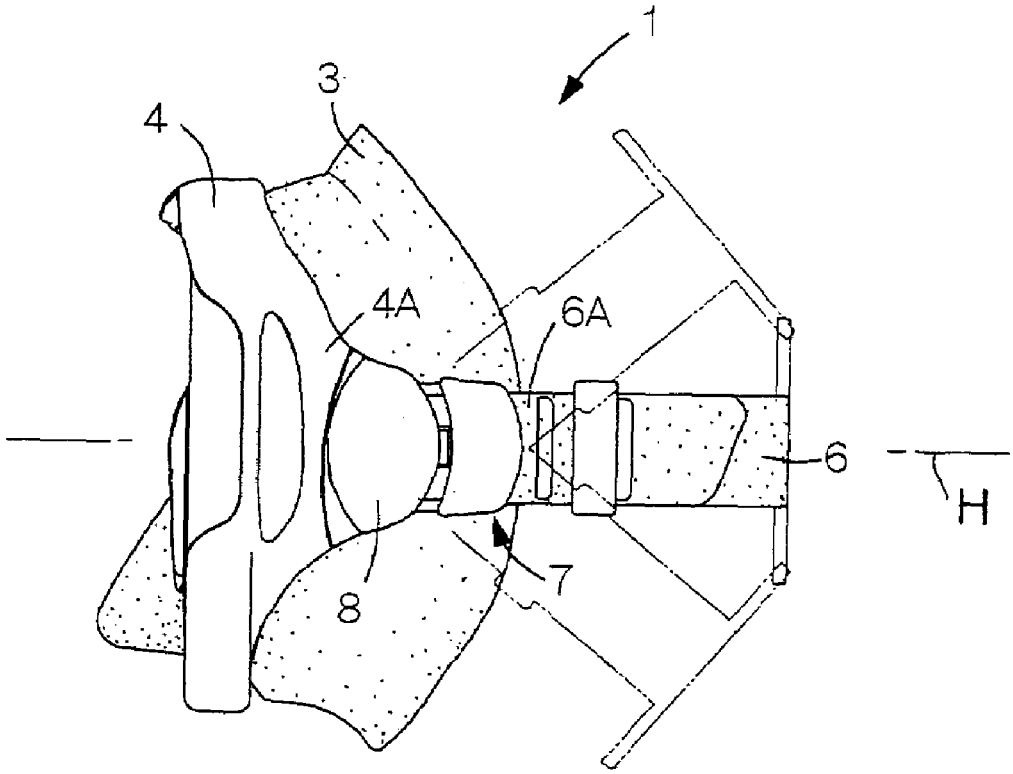
FIG. 2 is a side view of the face mask.

FIGS. 1 and 2 are front and side views, respectively, of a face mask for diving according to this invention. The face mask 1 is bilaterally symmetrical as viewed in FIG. 1 and comprises a front lens 2, a skirt 3, a lens frame 4 adapted to fix a front end of the skirt 3 to a peripheral edge of the lens 2, a strap 6 put around a mask wearer's head and buckles 7 adapted to connect longitudinally opposite extremities 6A of the strap 6 to opposite side walls 4A of the lens frame 4, respectively so that a length of the strap 6 can be adjusted. The buckles 7 are partially covered with side covers 8 detachably mounted on the lens frame 4. To wear this face mask 1, the strap 6 is put around the wearer's head with a rear end of the skirt 3 placed against the wearer's face. Referring to FIG. 2, a position of the strap 6 extending rearward along a horizontal line H which is orthogonal to the lens 2 can be adjusted by clockwise or counterclockwise rotating the buckles 7 as indicated by imaginary lines and thereby varying an angle of the buckles 7 relative to the lens frame 4.

Figure 3:
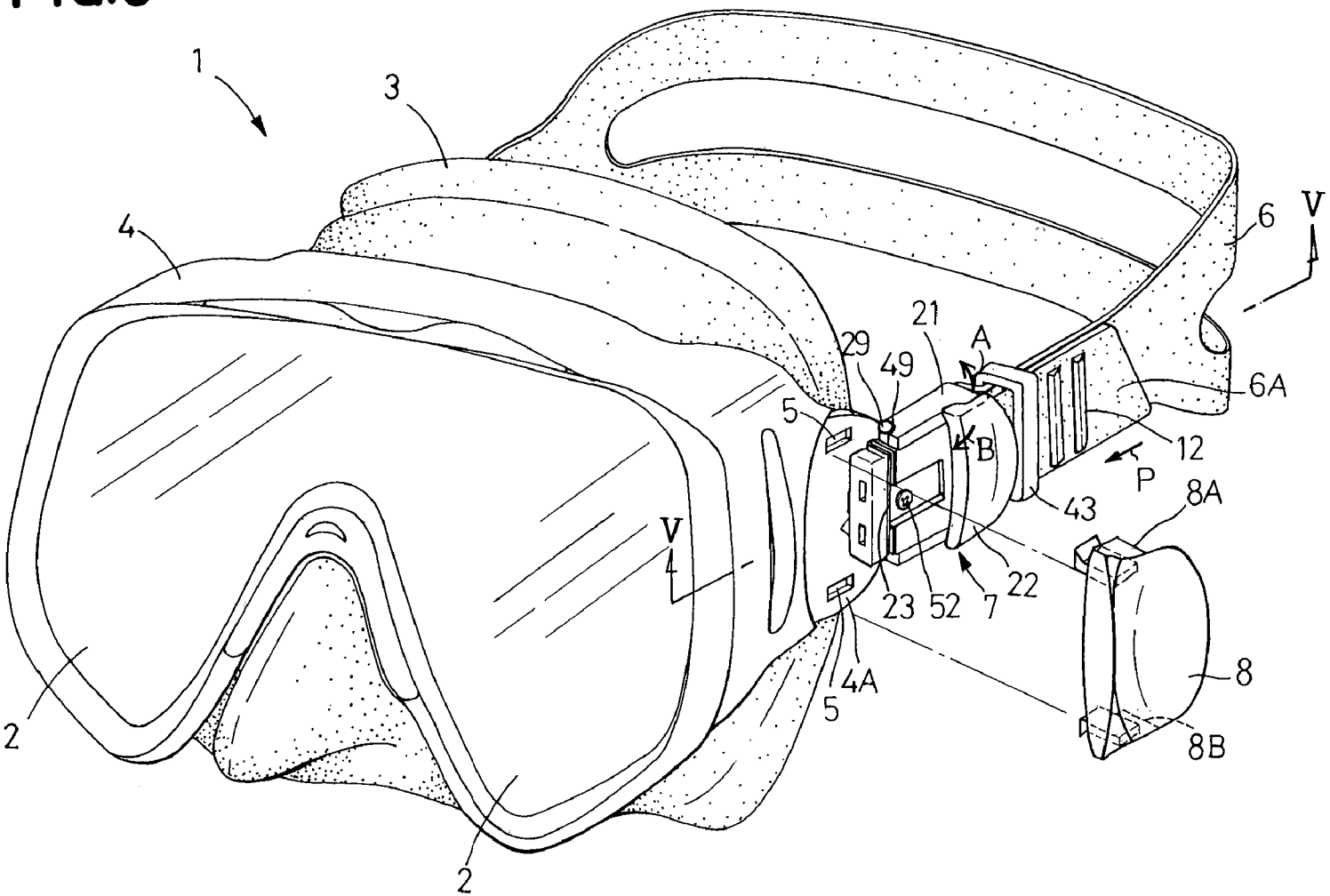
FIG. 3 is a perspective view of the face mask.
Figure 4:
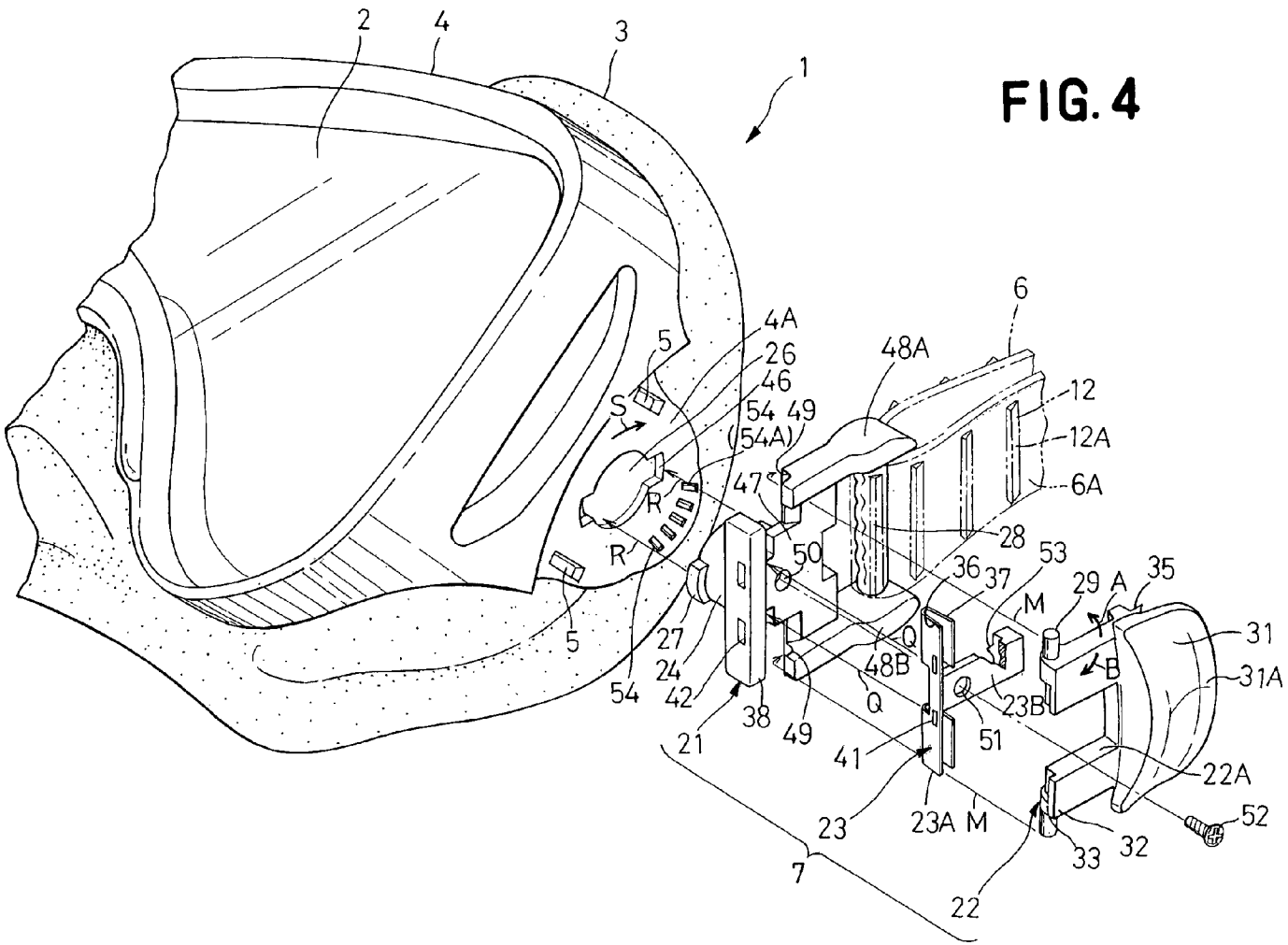
FIG. 4 is a partial exploded perspective view of the face mask.

FIGS. 3 and 4 show the face mask 1 in a perspective view and a partially exploded perspective view, respectively. The frame 4 of the mask 1 is formed with two pairs of through-holes 5 on the respective side walls 4A and the through-hole 5 are spaced apart from each other in a vertical direction. By means of these through-holes 5, the side covers 8 can be detachably coupled to the frame 4. FIG. 3 illustrates one of the covers 8 as has been detached from the frame 4 and this cover 8 is not illustrated in FIG. 4 merely for the purpose of simplification. The strap 6 is made of flexible elastic material such as rubber or plastic elastomer and defined by a longitudinal direction corresponding to a circumferential direction of the wearer's head, a transverse direction corresponding to the vertical direction as viewed in FIGS. 3 and 4 and a thickness direction orthogonal to these two directions. Each of the longitudinally opposite extremities 6A is formed on its one side with a plurality of first engagement teeth 12 spaced apart from one another in the longitudinal direction of the strap 6 and each of these teeth 12 fully extends in the transverse direction of the strap 6. Each of the buckles 7 comprises a first supporting member 21, a second supporting member 22 and a spring member 23 interposed between these first and second supporting members 21, 22. The spring member 23 is fixed to the first supporting member 21 by means of a screw 52. The second supporting member 22 has pivot pins 29 extending in the transverse direction of the strap 6 and adapted to be brought into bearings 49 of the first supporting member 21 in a direction of an arrow M. The pivot pin 29 is received in the bearing 49 of the first supporting member 21 so that the second supporting member 22 can pivot in both directions of the arrows A and B. The strap 6 extending forward are folded back by the respective buckles 7 so that the longitudinally opposite extremities 6A is directed to rearward of the mask 1 and put though respective belt loops 43.

Referring now to FIG. 4, each of the frame side walls 4A is formed with a through-hole 26 and a plurality of depressions 54 arranged on one and same circular circumference defined around the through-hole 26. The through-hole 26 is formed with a pair of guide grooves 46 for stoppers 27 radially opposed to each other. The first supporting member 21 making a part of each buckle 7 comprises a planar plate 47 extending parallel to the associated side wall 4A of the frame 4, a wall section 38 formed on a front end of the plate 47 and a pair of side wall sections 48A, 48B formed integrally with the plate 47 and extending rearward parallel to each other. The bearings 49 formed in the side wall sections 48A, 48B have circular arc-shaped concave surfaces. A surface of the plate 47 opposed to the frame side wall 4A is formed with a cylindrical shaft 24 from which a pair of stoppers 27 extend radially outwardly. The shaft 24 is inserted into the through-hole 26 of the frame side wall 4A serving as a bearing in a direction of an arrow R so that the stoppers 27 go through the guiding grooves 46, respectively. Then the first supporting member 21 is rotated clockwise, i.e., in a direction of an arrow S so that the stoppers 27 may be placed against the frame side wall 4A from the inside of the mask 1. In this manner, the first supporting member 21 is rotatably coupled to the frame side wall 4A (See FIG. 5). In the vicinity of the rear end of the first supporting member 21, the associated extremity 6A of the strap 6 turns round along a periphery of a pin 28 extending in the transverse direction of the strap 6.

The second supporting member 22 making a part of the buckle 7 comprises the pivot pins 29 extending in a vertical direction as viewed in FIG. 4, a first arm section 31 extending from the pivot pins 29 rearward of the mask 1 and a second arm section 32 extending forward from the respective pivot pins 29. The pivot pins 29 may be brought into engagement with the respective bearings 49 in the direction of the arrow M so as to be supported by the first supporting member 21 (See FIG. 3), so the second supporting member 22 can be rotated around the pivot pins 29 selectively in one of the directions of the arrows A and B with the wearer's finger applied to a rear end 31A of the first arm section 31. A rear side wall 37 of the spring member 23 is pressed against forward end 33 of the second arm section 32 (See FIG. 3).

The spring member 23 comprises a first spring component 23A having a U-shaped cross-section and fully extending in the transverse direction of the strap 6 and a second spring component 23B extending in a direction orthogonal to the first spring component 23A, i.e., in the longitudinal direction of the strap 6. The first spring component 23A is inserted in a direction of an arrow Q between the wall section 38 of the first supporting member 21 and the forward end 33 of the second supporting member 22. The first spring component 23A has front and rear walls 36, 37 extending side by side and these walls 36, 37 are pressed against the wall section 38 of the first supporting member 21 and the forward end 33 of the second supporting member 22 and thereby elastically compressed in such a manner that a width of the U-shape defined by these front and rear walls 36, 37 is correspondingly reduced. In this compressed state, the spring member 23 biases the second supporting member 22 to be rotated in the direction of the arrow A. The second spring component 23B is formed, in the vicinity of its rear end, with a protrusion 53 extending toward the frame side wall 4A and adapted to be detachably engaged with one of the depression 54 arranged on the frame side wall 4A (See FIG. 5). The spring member 23 is fixed to the first supporting member 21 by rotating a screw 52 into a threaded hole 50 via a through-hole 51 of the second spring component 23B. Thereupon, the second spring component 23B is received in a forwardly opened square U-shaped cutout 22A of the second supporting member 22.

Figure 5:
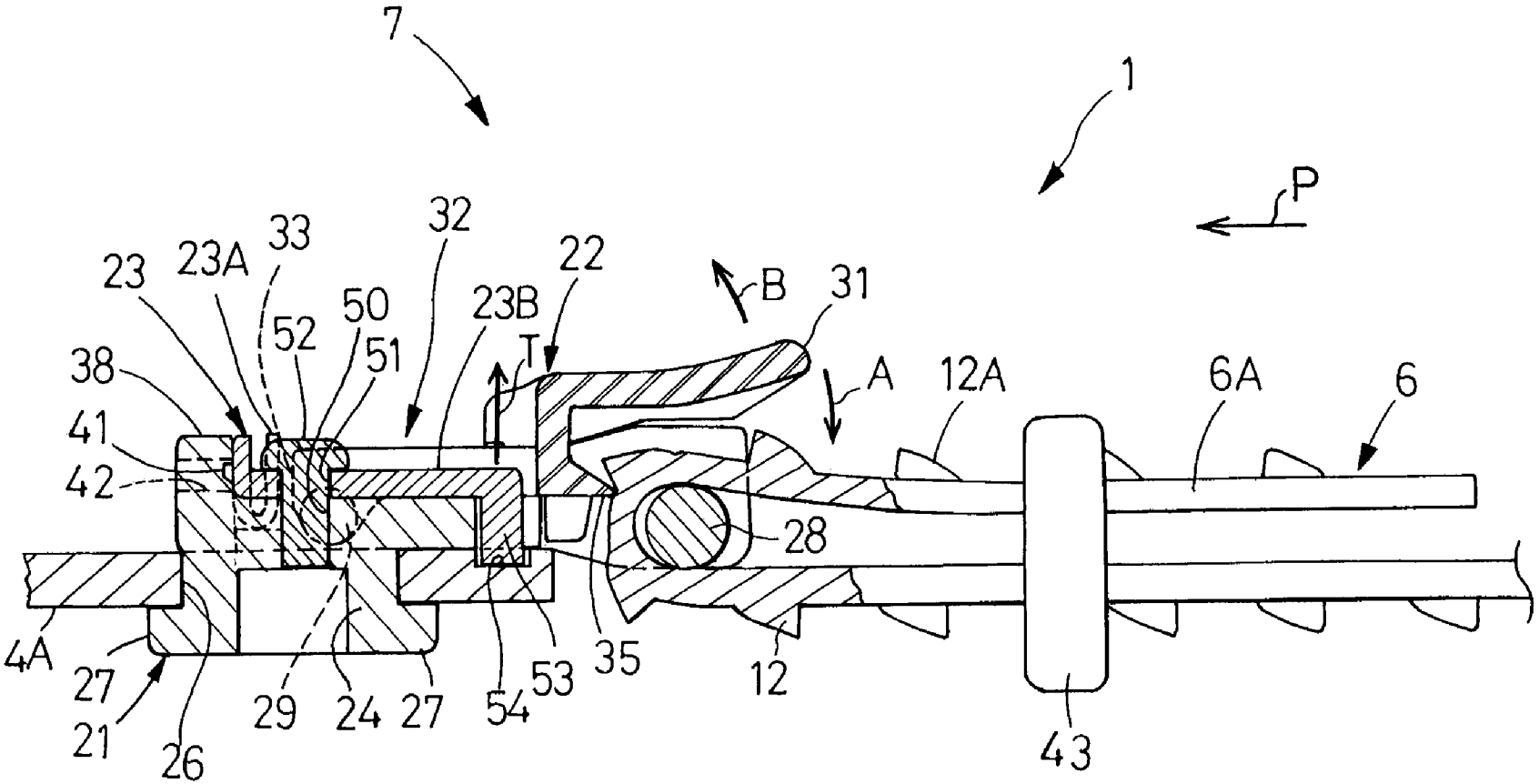
FIG. 5 is a sectional view taken along line V—V in FIG. 3.

FIG. 5 is a sectional view taken along a line V—V in FIG. 3, in which a part of the strap 6 is illustrated from the side. In the illustrated state of the buckle 7, the shaft 24 of the first supporting member 21 has been inserted into the through-hole 26 of the frame side wall 4A while the stoppers 27 are placed against the peripheral edge of the through-hole 26 from the inside of the mask 1 (from below as viewed in FIG. 5). The spring member 23 is fixed to the first supporting member 21 by the screw 52 and the first spring component 23A thereof indicated by an imaginary line is interposed between the wall section 38 defining the forward end of the first supporting member 21 and the forward end 33 of the second supporting member 22. As for the first spring component 23A, small protrusions 41 extending forward from the first spring component 23A come in engagement with holes 42 formed in the wall section 38 of the first supporting member 21 to retain the spring member 23 between the first and second supporting members 21, 22. As for the second spring component 23B, the protrusion 53 extending downward from a rear end of the component 23B as viewed in FIG. 5 comes in engagement with one of the depressions 54 formed on the frame side wall 4A. The protrusion 53 may be elastically deformed so as to shift upward, i.e., in a direction of an arrow T and disengaged from the depression 54 as the buckle 7 is rotated around the shaft 24. The second supporting member 22 has a second stopper tooth 35 formed on the inner side of its first arm section 31. In the illustrated state, this second stopper tooth 35 is pressed against one of the first stopper teeth 12 formed on the strap 6 from the front under a biasing force to the direction of the arrow A which is exerted by the first spring component 23A so as to prevent the extremity 6A of the strap 6 from moving in a direction of an arrow P. With such a function of the second supporting member 22, it is not likely that the strap 6 may be unintentionally slackened. Pulling the extremity 6A of the strap 6 so that the strap 6 may move in the direction opposite to the direction of the arrow P causes a slant face 12A of the first stopper tooth 12 to push the first arm section 31 upward in the direction of the arrow B (See FIG. 3) so that the strap 6 can move so as to be tightened around the wearer's head.

Figure 6:
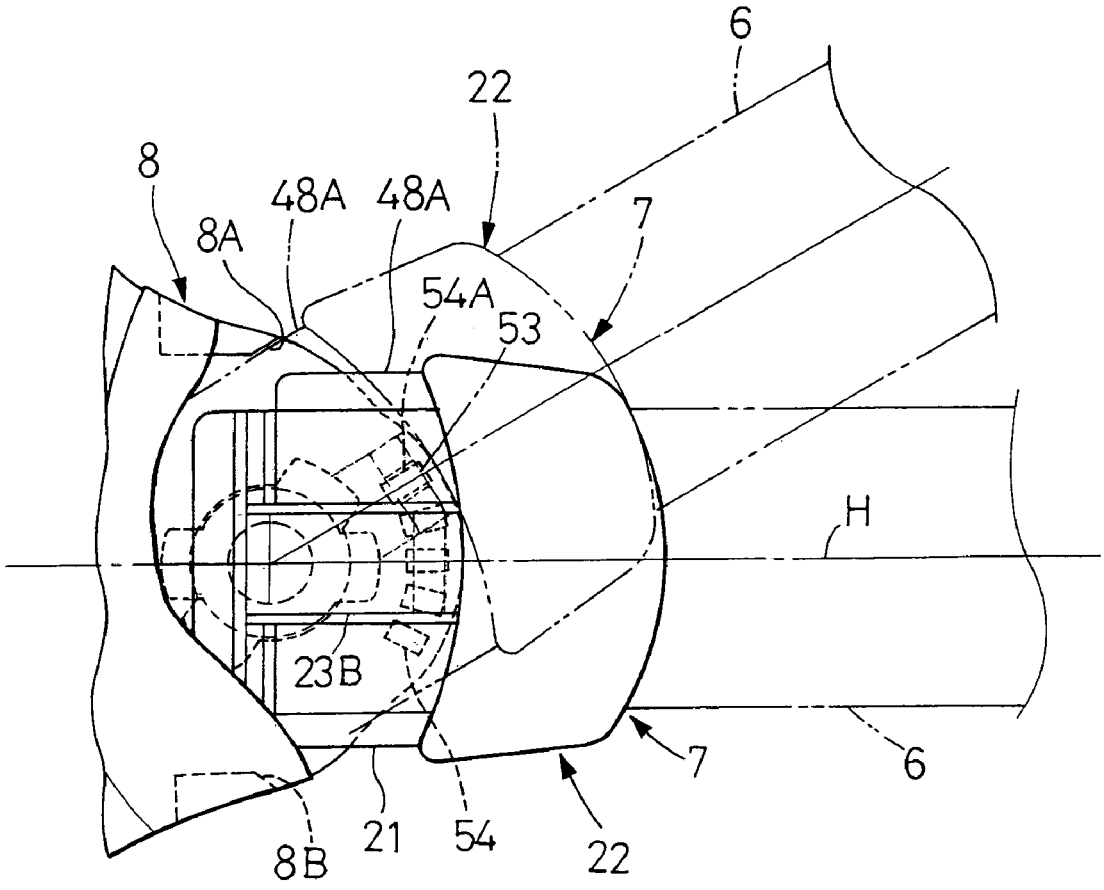
FIG. 6 is a partially scale-enlarged view of the face mask.

FIG. 6 is a view showing a part of FIG. 2 in an enlarged scale. In FIG. 6, solid lines indicate the buckle 7 to which the strap 6 extending rearward along the horizontal line H is connected, on the other hand, imaginary lines indicate the buckle 7 rotated in a counterclockwise so that the strap 6 may extend obliquely upward and the protrusion 53 of the second spring component 23B may be engaged with the uppermost depression 54A of the depressions 54 circumferentially arranged on the frame side wall 4A (See FIG. 4). If the face mask wearer counterclockwise rotates the buckle 7 indicated by the slid lines, the second spring component 23B is elastically deformed so that the protrusion 53 may come off the depression 54. The buckle 7 can be rotated until the protrusion 53 is engaged with next depression 54. The buckle 7 is retained at this position unless an added force is exerted upon the buckle 7. The protrusion 53 is engaged with the uppermost depression 54A as seen in FIG. 4 when the added force is exerted upon the buckle 7 to rotate counterclockwise. Thereby the strap 6 is brought to its position indicated by the imaginary lines in FIG. 6. The buckle 7 can be rotated clockwise also. In this way, it is possible for the face mask 1 according to this invention to regulate an angle of the strap 6 relative to the horizontal line H by engaging the protrusion 53 formed on the second spring component 23B of the buckle 7 with the desired one of the depressions arranged on the frame side wall 4A.

During use of the face mask 1, even if the protrusion 53 moves beyond the uppermost depression 54A as the buckle 7 is counterclockwise rotated, further rotation is stopped as the side wall section 48A of the first supporting member 21 comes up against a side wall section 8A of the cover 8 (See FIGS. 3 and 6) attached to the associated frame side wall 4A. On the other hand, clockwise rotation of the buckle 7 is stopped as the side wall section 48B of the first supporting member 21 comes up against a side wall section 8B of the cover. So long as the buckle 7 rotates between these side wall sections 8A, 8B, there is no anxiety that the stoppers 27 of the buckle 7 might coincide with the guide grooves 46 and the buckle 7 might fall off from the frame side wall 4A. While the first engagement member is in form of the protrusion 53 extending from the second spring component 23B and the second engagement member is in form of the depressions 54 formed on the frame side wall 4A in the illustrated embodiment, these first and second engagement members may be implemented in the other appropriate forms so far as these engagement members can be releasably engaged one with another. It is also possible without departing from the scope of this invention to replace the protrusion 53 by a depression and vice versa. The angle included between each pair of the adjacent depressions 54 arranged on one and same circular circumference as well as the total number of these depressions 54 is not limited to those in the illustrated embodiment. Preferably, three to nine depressions 54 are formed on the frame side wall 4A with the angle of 10° to 20° included between each pair of the adjacent depressions 54. It is also possible without departing from the scope of this invention to form the second spring component 23B with a plurality of protrusions 53 arranged on one and same circular circumference.

For implementation of this invention, the first and second supporting members 21, 22 in the buckle 7 may be formed by rigid plastic material and the spring member 23 may be formed by various types of material such as rigid plastic material, plastic elastomer, rubber or metal. While the first and second spring components 23A, 23B are formed integrally with each other in the illustrated embodiment, these two components may be separately formed using materials different from each other. The face mask 1 of this invention can be used not only for diving but also for skiing or motorbike riding.

What is claimed is:

1. A face mask comprising:

a front lens;

a skirt extending rearward from said front lens;

a lens frame adapted to fix a front end of said skirt to a peripheral edge of said lens;

a strap put around a mask wearer's head and buckles, and means for rotatably coupling each buckle to a respective side wall of said lens frame, the buckles used to adjust a length of said strap along its longitudinally opposite extremities, respectively;

and means for retaining each of said rotatably coupled buckles in a predetermined rotatable position with respect to said side wall, said retaining means further comprising a first engagement member formed on each of said side walls of said lens frame and a second engagement member formed on said buckle associated with said side wall and one of said first and second engagement members is provided in the form of a plurality of depressions and the other is provided in the form of a protrusion adapted to be releasably engaged with one of said depressions while each said buckle is rotatably coupled to each said side wall to position said buckle in said predetermined rotatable position.

2. The face mask according to claim 1, wherein the other of the first and second engagement members is provided in the form of a plurality of protrusions adapted to be releasably engaged with said depressions.

3. The face mask according to claim 1, wherein said lens frame or each of said buckles is provided with a stopper means serving to prevent said buckle from rotating to a position at which said buckle falls off from said lens frame during use of said face mask.

4. A face mask comprising:

a front lens;

a skirt extending rearward from said front lens;

a lens frame adapted to fix a front end of said skirt to a peripheral edge of said lens;

a strap put around a mask wearer's head and buckles rotatably coupled to opposite side walls of said lens frame used to adjust a length of said strap along its longitudinally opposite extremities, respectively;

and an angle control means being formed on each of said side walls of said lens frame and each of said buckles associated with said side wall and adapted to be releasably brought into mutual engagement so as to retain said buckle at a predetermined rotation angle with respect to said side wall;

wherein each of said buckles comprises a first supporting member having a shaft adapted to be detachably and rotatably engaged with a bearing formed on said side wall of said lens frame, a second supporting member opposed to said first supporting member with said strap lying therebetween and having one end in a longitudinal direction of said strap pivotably supported by said first supporting member and a spring means interposed between said first and second supporting members and biasing the other end of said second supporting member to be pressed against said strap and said second engagement member is formed integrally with said spring means.

5. A face mask according to claim 4, wherein said spring means comprises a first spring component extending in a transverse direction of said strap and pressed against said first and second supporting members, and a second spring component extending from said first spring component in said longitudinal direction of said strap and adapted to be elastically and releasably engaged with said first engagement member formed on said side wall of said lens frame.

* * * * *